US007594707B2

(12) United States Patent
Kunkle et al.

(10) Patent No.: US 7,594,707 B2
(45) Date of Patent: Sep. 29, 2009

(54) SNAP-IN BEARING RACK AND PINION SYSTEM

(75) Inventors: Aidan Carl Kunkle, Evansville, IN (US); Frank Weston Maglinger, Evansville, IN (US); Richard Bruce Mills, Evansville, IN (US); Daryl Lee Reuter, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 55 days.

(21) Appl. No.: 11/838,978

(22) Filed: Aug. 15, 2007

(65) Prior Publication Data

US 2009/0045713 A1 Feb. 19, 2009

(51) Int. Cl.
*A47B 96/04* (2006.01)

(52) U.S. Cl. ..... 312/402; 312/404; 312/331; 312/334.8

(58) Field of Classification Search ..... 312/402, 312/404, 408, 410, 116, 331, 334.7, 334.8; 62/402, 382

See application file for complete search history.

(56) References Cited

U.S. PATENT DOCUMENTS

| | | | | |
|---|---|---|---|---|
| 3,857,618 | A | 12/1974 | Hagen et al. | |
| 4,351,575 | A | 9/1982 | Rock et al. | |
| 4,470,642 | A | 9/1984 | Gasperin | |
| 5,409,309 | A * | 4/1995 | Giddings et al. | 312/331 |
| 5,913,584 | A * | 6/1999 | Swindell et al. | 312/408 |
| 5,970,887 | A * | 10/1999 | Hardy | 108/108 |
| 6,499,818 | B2 | 12/2002 | Brustle | |
| 6,641,239 | B2 * | 11/2003 | Kaiser | 312/404 |
| 6,971,730 | B2 | 12/2005 | Koons | |
| 7,240,980 | B2 * | 7/2007 | Koons | 312/404 |
| 7,430,937 | B2 * | 10/2008 | Rotter et al. | 62/302 |
| 2003/0067257 | A1 | 4/2003 | Gasser | |
| 2004/0050841 | A1 * | 3/2004 | Han et al. | 219/685 |
| 2005/0156494 | A1 | 7/2005 | Bergmann et al. | |
| 2005/0160854 | A1 | 7/2005 | Rotter | |
| 2006/0087208 | A1 | 4/2006 | Oh et al. | |
| 2006/0192469 | A1 | 8/2006 | Koo | |
| 2006/0250059 | A1 | 11/2006 | Lemm | |

FOREIGN PATENT DOCUMENTS

| | | | | |
|---|---|---|---|---|
| DE | 8905197 | U1 | 6/1989 | |
| EP | 0656182 | A1 | 6/1995 | |
| EP | 1036526 | A1 | 9/2000 | |
| JP | 05340664 | A * | 12/1993 | 62/382 |
| WO | 2007/007950 | A1 | 1/2007 | |

* cited by examiner

*Primary Examiner*—Hanh V Tran
(74) *Attorney, Agent, or Firm*—Kirk W. Goodwin; Robert L. Judd

(57) ABSTRACT

A snap-in rack and pinion stabilizing system for a cabinet drawer including first and second slide assemblies mounted in the cabinet, a rack gear connected to each of the first and second slide assemblies, and spaced mounting brackets connected to the drawer having opposite sides and a bottom edge. The rack and pinion stabilizing system also includes a snap-on pinion gear assembly including a shaft, first and second pinion gears mounted on opposite ends of the shaft, and first and second bearing brackets. The bearing brackets rotatably support the shaft and are arranged to snap-in to latch surfaces on the mounting brackets with the pinion gears engaging the rack gears.

17 Claims, 10 Drawing Sheets

SNAP-IN BEARING RACK AND PINION SYSTEM

BACKGROUND OF THE INVENTION

1. Field of the Invention

The present invention pertains to the art of refrigerators, and more particularly, to a support arrangement having a rack and pinion stabilizing system for a pull-out freezer drawer.

2. Description of the Related Art

Pull-out drawers in a refrigerator cabinet, and in particular bottom mount freezers in which the freezer compartment is located at the bottom of the refrigerator while the fresh food compartment is located at the top of the refrigerator, are often used to increase versatility of storing a wide range of food items, and for increasing the accessibility of items stored in the lower portion of the refrigerator cabinet. These bottom mounted freezer drawers are typically mounted on slides or glides fastened to the sidewalls of the inner liner of the refrigerator cabinet and telescopically extend horizontally toward the opening of the refrigerator. Unfortunately, these slides can extend at different rates when the large drawer is opened and closed, particularly when the horizontal force (i.e. the consumer pushing or pulling the drawer) is not centered. The effect of the different rates of extension can create a "wobble" or "racking" as the drawer is extended or inserted. This drawer rack or wobble typically can occur when the velocity of the drawer and slide assembly varies with position along the face of the drawer as it is extended or inserted.

Rack and pinion stabilizing assemblies have been provided to help insure that both slide assemblies move at the same speed as the drawer is extended or inserted. One problem with rack and pinion stabilizing assemblies is aligning the gear wheels on the sides of the drawer with the associated rack gears during assembly of the drawer to the cabinet or mounting structure.

SUMMARY OF THE INVENTION

The invention relates to a rack and pinion stabilizing system for a pull-out apparatus having spaced mounting brackets including first and second slide assemblies positioned to movably support the pull-out apparatus and having a rack gear associated with each of the first and second slide assemblies and a snap-on pinion gear assembly. The snap-on pinion gear assembly includes a shaft, first and second pinion gears on opposite ends of the shaft, and first and second bearing brackets rotatably supporting the shaft. Each bearing bracket includes at least one latch surface arranged to engage a mounting bracket to attach the pinion gear assembly to the pull-out apparatus with each pinion gear engaging a rack gear.

The rack gear can be part of a C-shaped channel connected to each of the first and second slide assemblies. The mounting brackets can include sides and a recess to receive the shaft and further can include at least one strike surface to engage the latch surface. The bearing brackets can include a journal to rotatably support the shaft, and can have a first member extending generally perpendicular to the journal and a second member extending generally perpendicular to the journal and generally parallel to the first member. The first member and the second member can be arranged to engage a mounting bracket. The first members can include two latch surfaces and the mounting brackets can include two strike surfaces.

The bearing bracket second members can include a rib extending generally perpendicular to the journal and toward the first member and the mounting brackets can include a slot extending generally perpendicularly from the recess to receive the rib to locate the bearing bracket with the latch surfaces aligned with the strike surfaces. The first member can be flexible to allow the latch surfaces to slide on the side of the mounting bracket and engage the strike surfaces as bearing brackets are mounted to the mounting brackets. The latch surfaces can have a ramp extending upwardly from the surface of the first members and a lock surface extending generally perpendicular from the surface of the first members to the distal end of the ramps. The strike surfaces can comprise an opening in the mounting brackets arranged to receive the latch surface with the lock surface engaging the edge of the opening.

In another aspect the invention relates to a rack and pinion stabilizing system for a cabinet drawer including first and second slide assemblies mounted in the cabinet, a rack gear connected to each of the first and second slide assemblies, and spaced mounting brackets connected to the drawer having opposite sides and a bottom edge. Each mounting bracket can include a recess in the bottom edge, a slot extending from the recess generally perpendicular to the bottom edge, and two strike surface openings in the mounting brackets adjacent the slot. The rack and pinion stabilizing system can also include a snap-on pinion gear assembly having a shaft, first and second pinion gears mounted on opposite ends of the shaft and first and second bearing brackets. The bearing brackets can include a journal arranged to rotatably support the shaft, a first member extending generally perpendicular to the journal, a second member extending generally perpendicular to the journal and generally parallel to the first member. The first and second members can be arranged to engage the opposite sides of the mounting bracket and the first members can have two latch surfaces each including a ramp extending upwardly from the surface of the first member and a lock surface arranged to engage the two strike surface openings in the mounting bracket. The second members can have a rib extending generally perpendicular to the journal and arranged to engage the slot to locate the bearing bracket with the latch surfaces aligned with the strike surface openings.

In another aspect the invention relates to a method for assembling a drawer and a rack and pinion stabilizing system in a cabinet including providing a cabinet having first and second slide assemblies including first and second rack gears and first and second spaced drawer mounting brackets, attaching at least a drawer element to the first and second drawer mounting brackets, providing a pinion gear assembly comprising: a shaft; first and second bearing brackets rotatably supporting the shaft; and first and second pinion gears at the opposite ends of the shaft, and assembling the pinion gear assembly to the drawer element by connecting the first and second bearing brackets to the first and second mounting brackets with the first and second pinion gears engaging the first and second rack gears.

In another aspect the invention relates to a method of assembling a freezer drawer having a rack and pinion stabilizing system in a refrigerator freezer cabinet drawer cavity including mounting rack gears to first and second slide assemblies, attaching mounting brackets to the first and second slide assemblies, mounting the first and second slide assemblies including the rack gears and mounting brackets to opposite side walls of the drawer cavity, attaching an insulated drawer front to the mounting brackets, providing a pinion gear assembly having a shaft, first and second bearing brackets rotatably supporting the shaft, and first and second pinion gears at the opposite ends of the shaft, extending the insulated drawer front to a fully extended position, and assembling the pinion gear assembly to the mounting brackets by connecting the first and second bearing brackets to respective mounting brackets with the first and second pinion gears engaging the rack gears.

The method can further include the step of assembling a container to the mounting brackets after the step of assembling the pinion gear assembly to the mounting brackets.

DESCRIPTION OF THE INVENTION

While the invention will be described in terms of freezer drawers and baskets, other drawers such as fresh food compartment drawers, drawers or baskets of other appliances, for example dishwashers, or furniture drawers, for example a file cabinet drawer, may be provided with a rack and pinion stabilizing system of the present invention. In the embodiment of a freezer drawer the slide assemblies of the present invention, described in more detail below, are attached to or supported by the side walls of the refrigerator. Drawer glides or slide assemblies are generally known. Any suitable drawer glide may be adapted to be operable with the present invention. Therefore, for purposes of the disclosing the invention, and for purposes of simplicity, only the relevant components and/or components of the drawer slide will be referenced herein.

Figure 1:
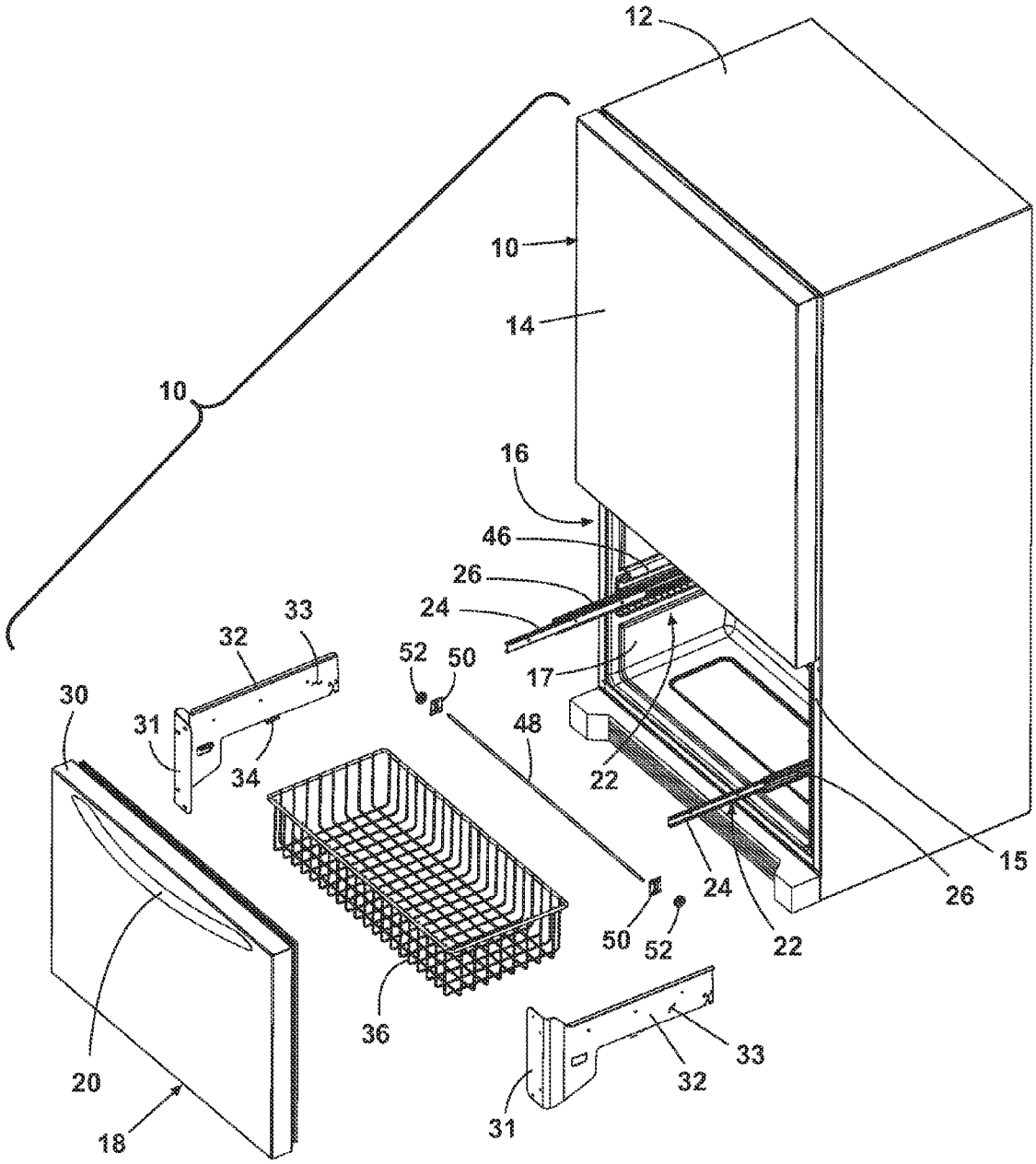
FIG. 1 is a partial exploded view of a bottom mount freezer style refrigerator incorporating the freezer drawer support assembly of the invention.
Figure 2:
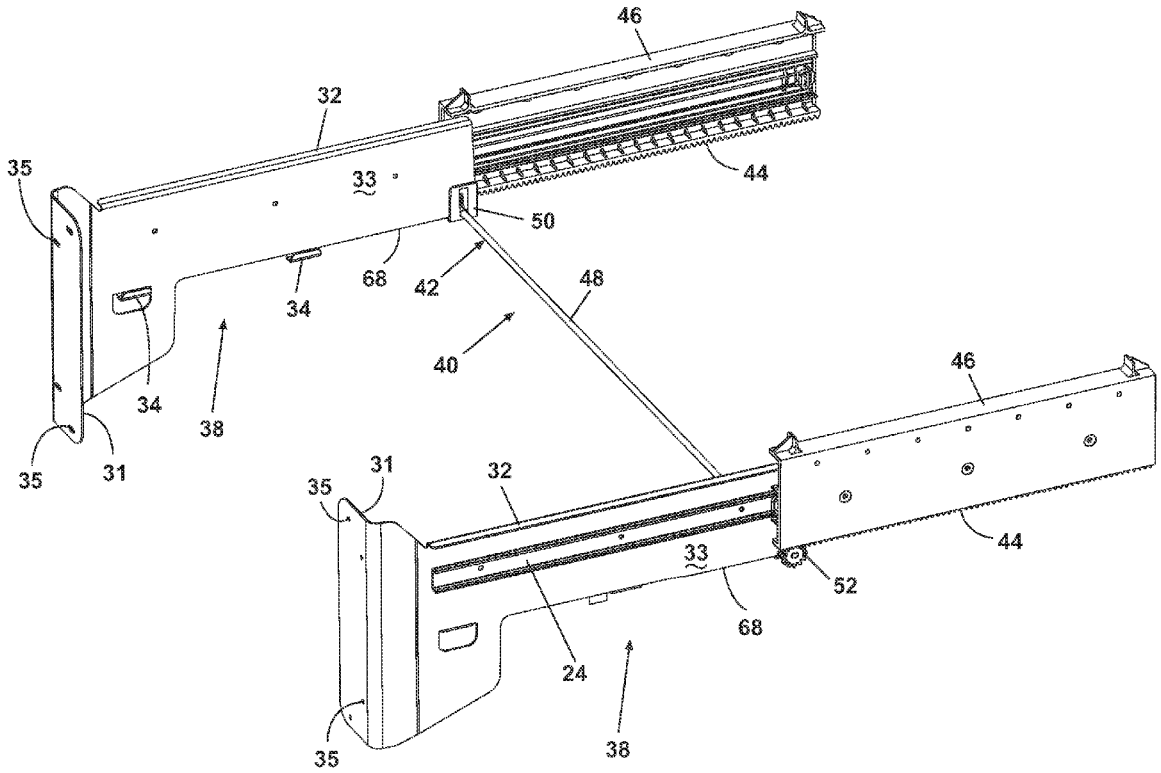
FIG. 2 is a perspective view of the drawer slide and bracket assembly with the snap-on pinion gear assembly attached to drawer mounting brackets removed from a refrigerator.
Figure 6:
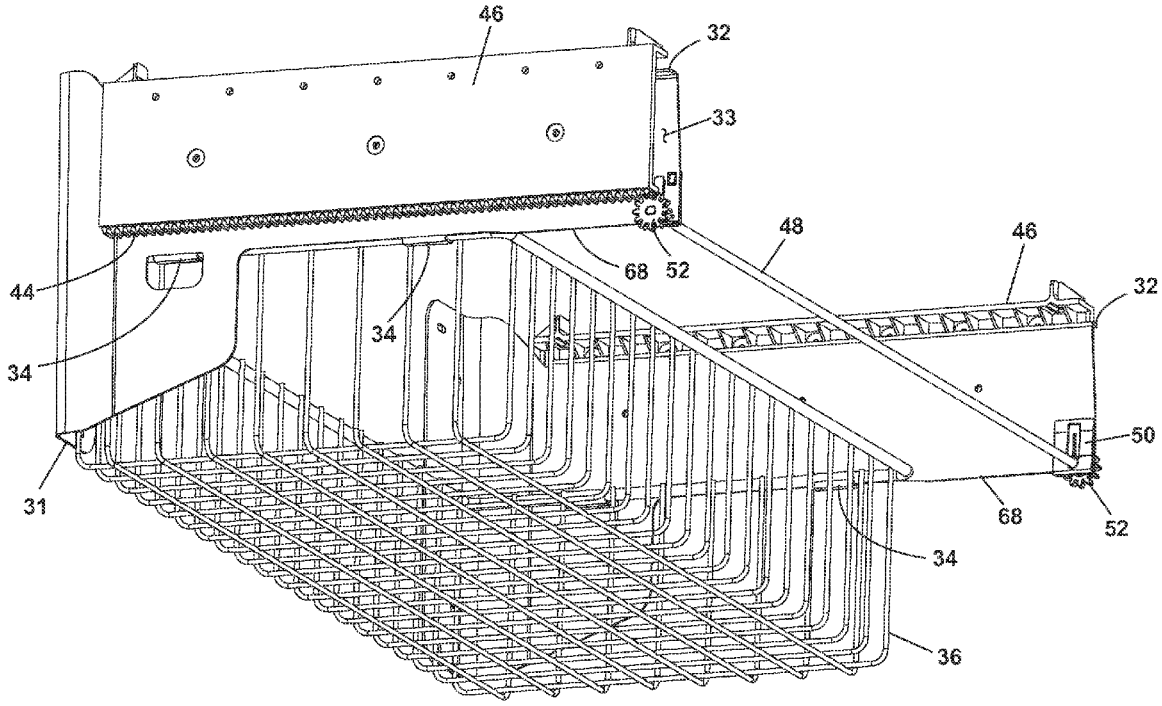
FIG. 6 is a partial perspective view of the drawer slide and bracket assembly showing a pinion gear engaging a rack gear.

With initial reference to FIGS. 1 and 2, a refrigerator incorporating the invention is generally indicated at 10. Refrigerator 10 can include a cabinet 12 to which a fresh food compartment door 14 can be attached. Refrigerator 10 constitutes a bottom mount freezer style refrigerator wherein the fresh food compartment door 14 seals off an upper fresh food compartment within cabinet 12. In a manner well known in the art fresh food compartment door 14 can be pivotally mounted to cabinet 12 about a vertical axis through hinges (not shown). Refrigerator 10 also includes a lower, or bottom mount, freezer compartment 16 having a drawer opening 15 forming a drawer cavity. Freezer compartment 16 can be closed by a freezer drawer 18. Freezer drawer 18 can have a handle 20 to facilitate extending and inserting freezer drawer 18. In accordance with the invention freezer drawer 18 can be adapted to slide towards and away from cabinet 12 through the use of a slide assembly generally indicated at 22 in order to selectively access or close the freezer compartment 16. Slide assembly 22 can include a three section, full extension slide that is well known in the art. Slide assembly 22 can include an inner section 24, a middle section 26 and an outer section 28 that can be slideably mounted together with ball bearings (not shown) movably supporting the three sections, again as well know to those skilled in the art. Slide assembly 22 can be plated metal. While a three section, full extension slide assembly is illustrated in this application those skilled in the art should understand that other slide arrangements can be used with a rack and pinion stabilizing system according to the invention. Freezer drawer 18 can have an insulated drawer front 30 and spaced mounting brackets 32. Drawer front 30 can be attached to mounting brackets 32 as will be described in greater detail below. Mounting brackets 32 can have one or more basket hooks 34 (see FIGS. 1, 2 and 6) to support a basket 36 between mounting brackets 32. Those skilled in the art will understand that basket 36 can be a wire basket as shown or can be a metal or plastic bin arranged to hang from one or more basket hooks such as basket hooks 34. Rack and pinion stabilizing system 40 can include a pinion gear assembly 42 and rack gears 44. Rack gears 44 can be part of the bottom surface of generally C-shaped channel 46 that can be attached to each slide assembly 22 as will be described in greater detail below. Pinion gear assembly 42 can include a shaft 48, first and second bearing brackets 50 and first and second pinion gears 52 that will be described in greater detail below. Mounting brackets 32 can be formed of powder coated steel and shaft 48 can be formed of powder coated steel or stainless steel. C-shaped channel 46 and rack gears 44 can be formed of polystyrene material including, but not limited to HIPS or ABS plastic material.

Figure 3:
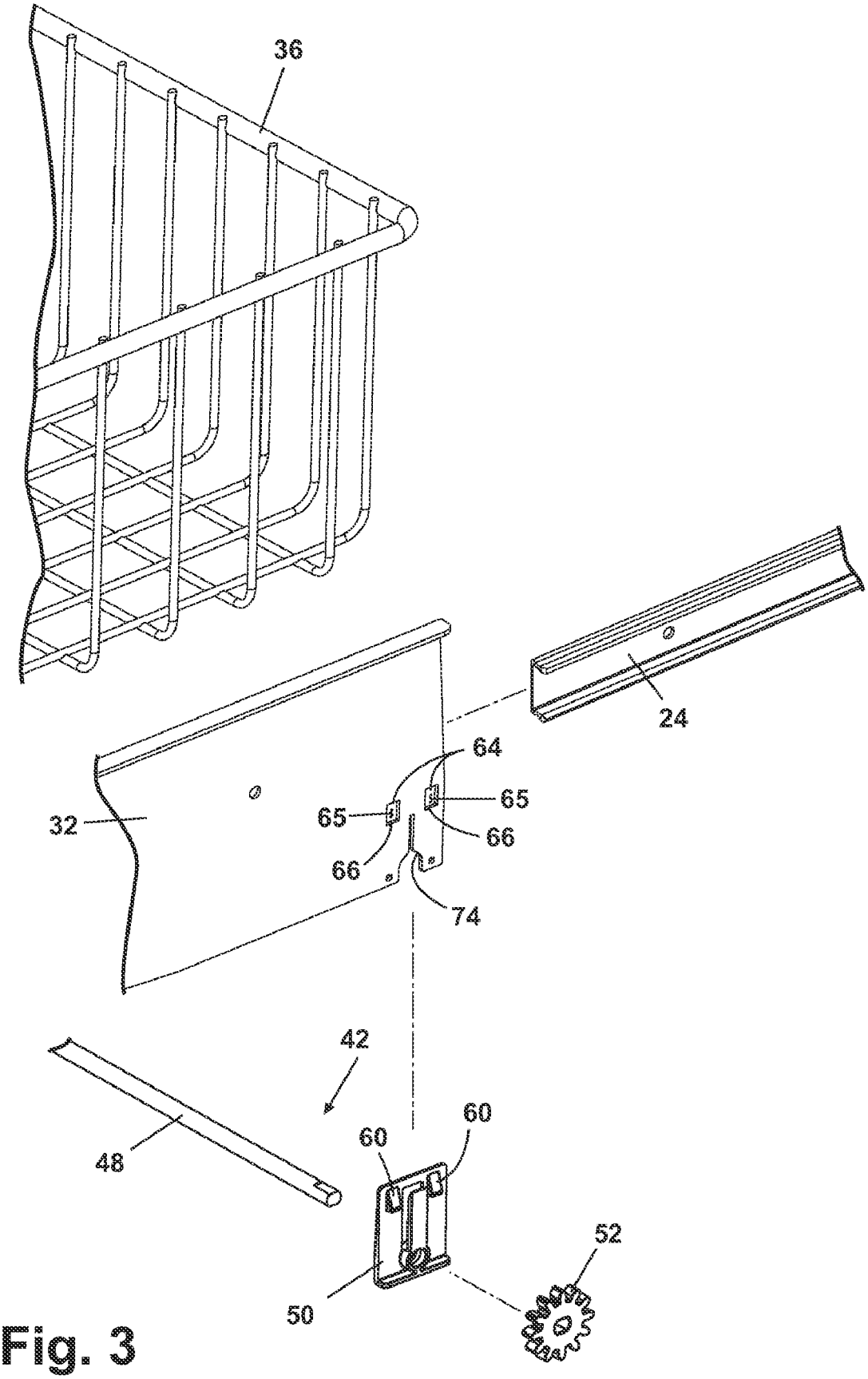
FIG. 3 is a partial exploded view of portions of the drawer slide and bracket assembly.
Figure 5A:
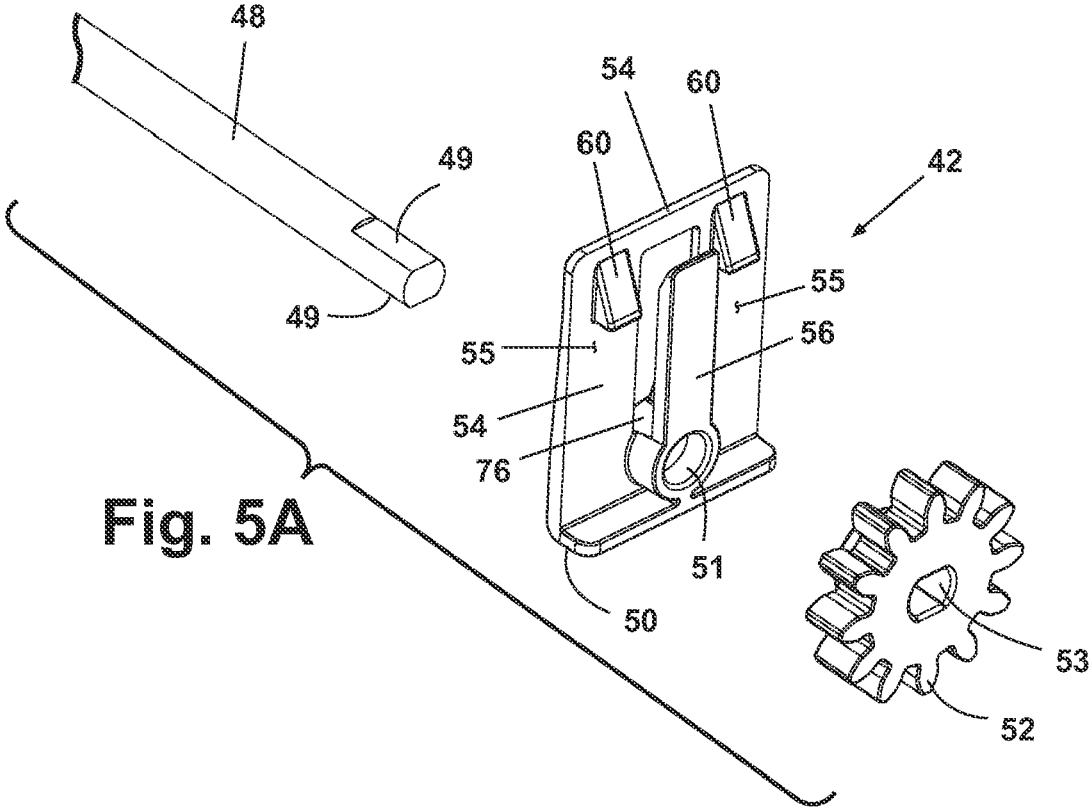
FIG. 5A is an partial exploded view of the snap-on pinion gear assembly.
Figure 5B:
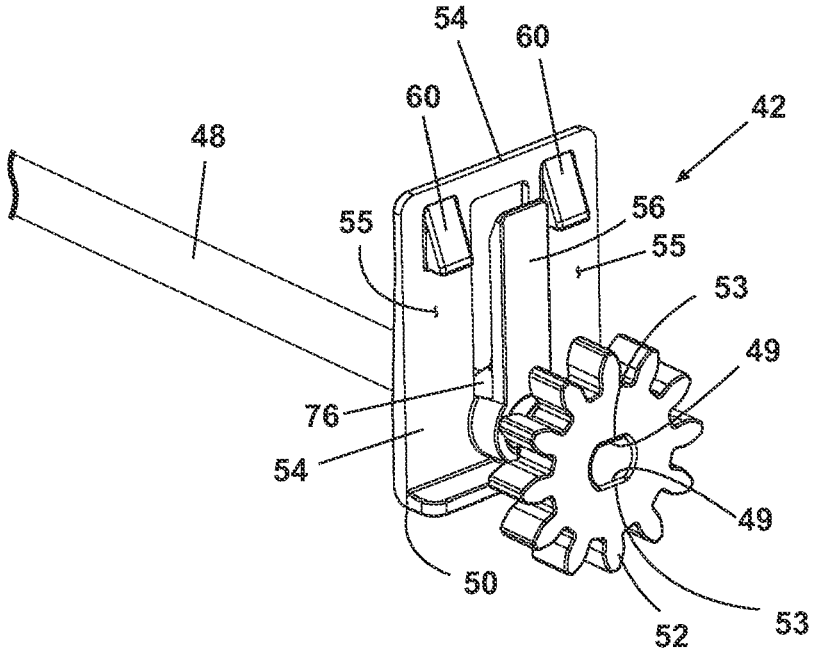
FIG. 5B is a partial perspective view of the snap-on pinion gear assembly.

As shown in FIGS. 3 and 5A, pinion gear assembly 42 can include a shaft 48 supported by a bearing bracket 50 and having a pinion gear 52 at each end of the shaft. Shaft 48 can have opposed flattened portions 49 on each end and pinion gears 52 can have a corresponding opening 53 to receive the flattened portion 49 at the end of shaft 48. Bearing bracket 50 can have a journal 51 that can rotatably support shaft 48. Pinion gear assembly 42 can be assembled by pressing a pinion gear 52 on one end of a shaft 48, sliding two bearing brackets 50 on the shaft 48 by inserting the shaft 48 into the respective journals 51 and pressing a pinion gear 52 on the opposite end of the shaft 48. Those skilled in the art will understand that pinion gears 52 can be attached to shaft 48 using other well known assembly techniques for a wheel and shaft including other shapes to prevent pinion gear 52 from rotating relative to shaft 48, for example D-shaped surfaces or splined surfaces, a pin to pin the pinion gear to shaft 48 or the use of suitable adhesives or spin welding to attach pinion gears 52 to shaft 48. Pinion gears 52 and bearing brackets 50 can be formed of acetal plastic material.

Figure 4A:
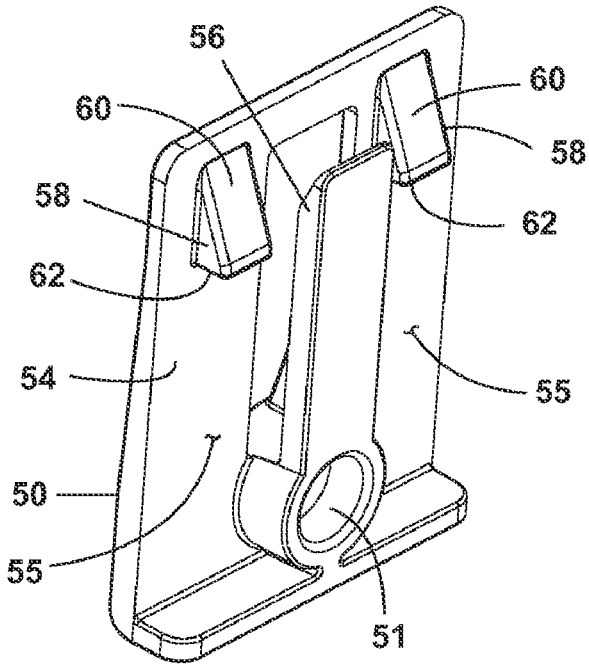
FIG. 4A is a perspective view of one side of the bearing bracket showing latch surfaces.
Figure 4B:
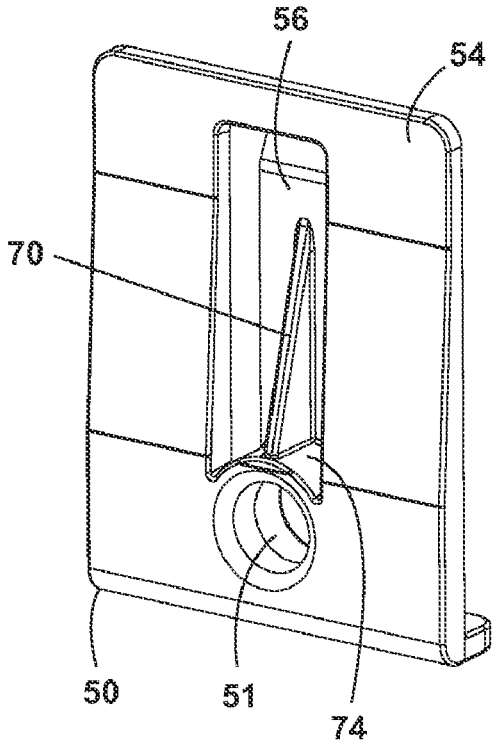
FIG. 4B is a perspective view of the opposite side of the bearing bracket showing a rib for locating a bearing bracket on a drawer mounting bracket.

Turning to FIGS. 4A and 4B bearing bracket 50 can be seen in greater detail. As noted above, bearing bracket 50 can include a journal 51 that can be arranged to rotatably support shaft 48. As shown in FIG. 4A, bearing bracket 50 can have a first member 54 extending generally perpendicular to journal 51 and a second member 56 that can also extend generally perpendicular to journal 51 spaced axially along journal 51. The space between the first member 54 and second member 56 can receive and engage opposite surfaces 33 of mounting bracket 32. First member 51 of a bearing bracket 50 can have at least one latch surface 58 spaced from journal 51. In the embodiment illustrated in FIGS. 4A and 4B bearing bracket 50 includes two latch surfaces 58. Latch surfaces 58 can be generally rectangular and can include a ramp 60 and a lock surface 62 on surface 55 of first member 54 that can engage strike 64 that can be formed in mounting brackets 32 (see FIGS. 3 and 8A). As illustrated, strike 64 can be a rectangular opening 65 in mounting bracket 32 shaped to receive a latch surface 58 that can include an edge 66 that can engage lock surface 62 to secure bearing bracket 50 to mounting bracket 32. First member 54 can be flexible to allow first member 54 to deflect away from second member 56 as bearing bracket 50 is assembled to mounting bracket 32.

Figure 7A:
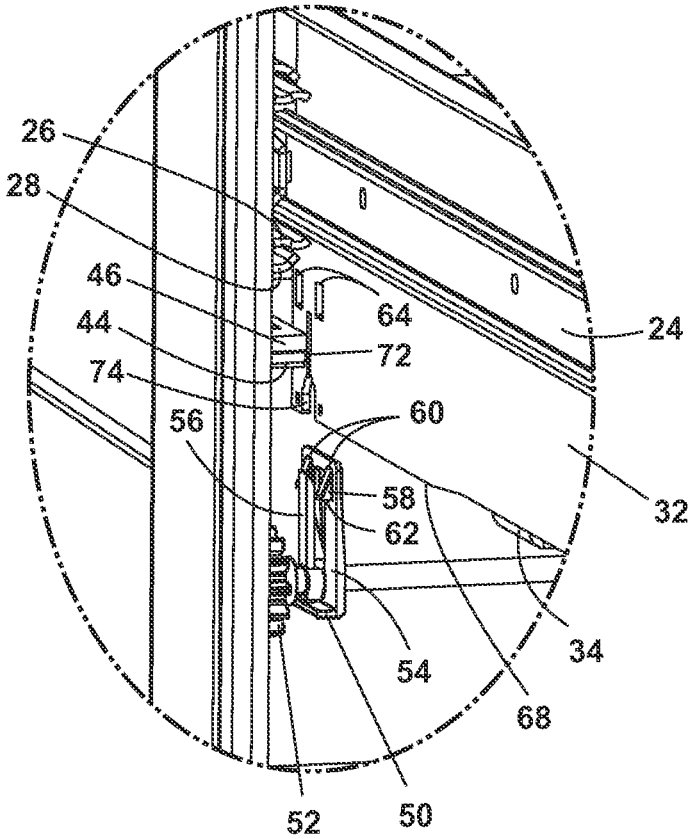
FIG. 7A is a partial perspective view of the a drawer slide and bracket assembly installed in a freezer compartment with the snap-on pinion gear assembly in position to be attached to the drawer mounting brackets.
Figure 7B:
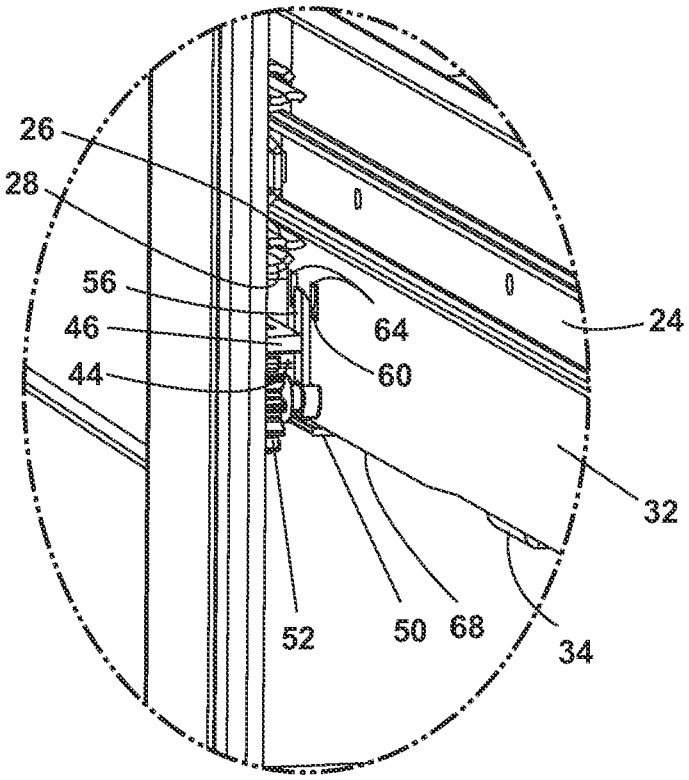
FIG. 7B is a partial perspective view of the drawer slide and bracket assembly installed in a freezer compartment with the snap-on pinion gear assembly attached to the drawer mounting brackets.
Figure 8A:
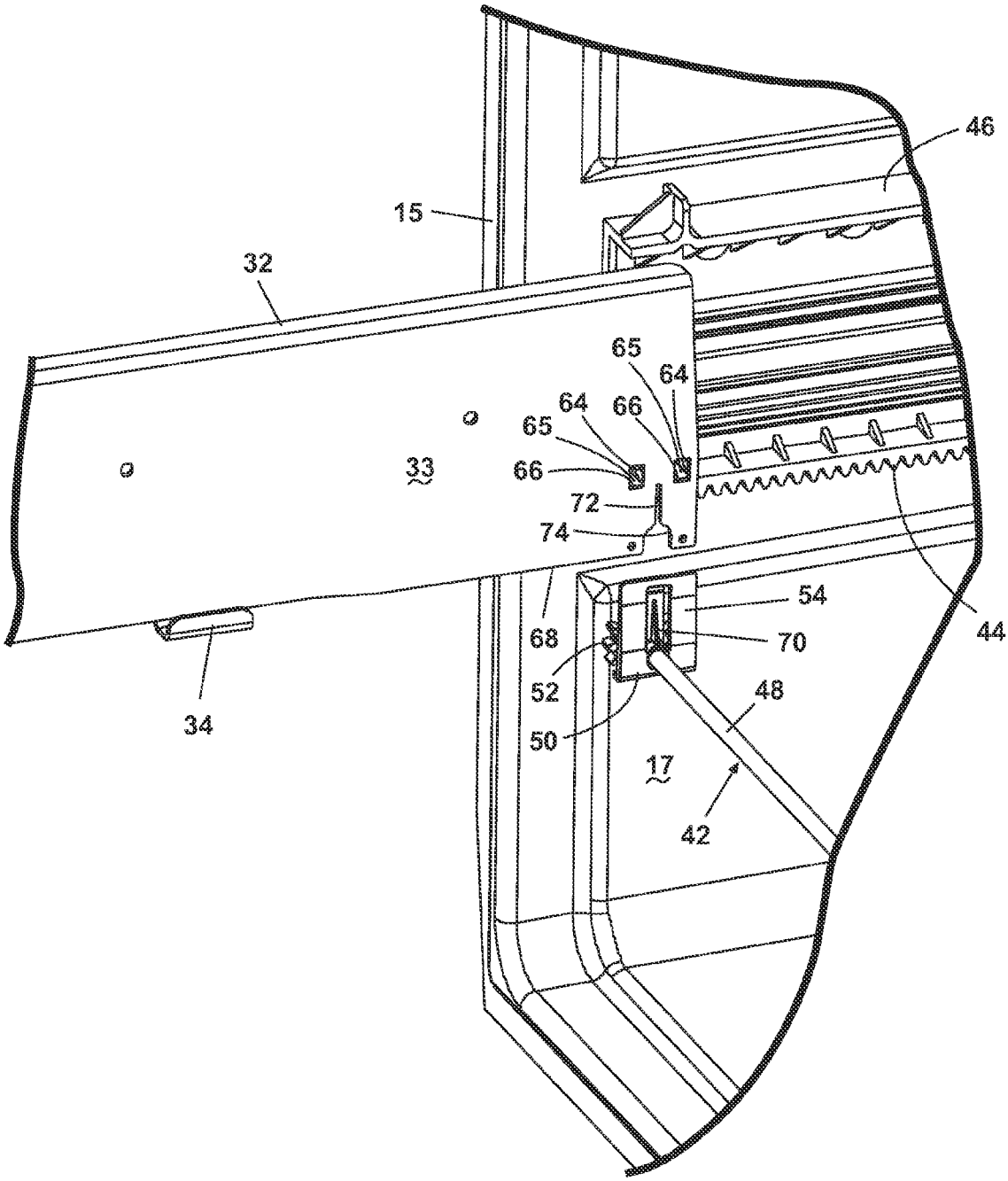
FIG. 8A is a partial perspective view of the drawer slide and bracket assembly installed in a freezer compartment with the snap-on gear assembly in position to be attached to the drawer mounting brackets.
Figure 8B:
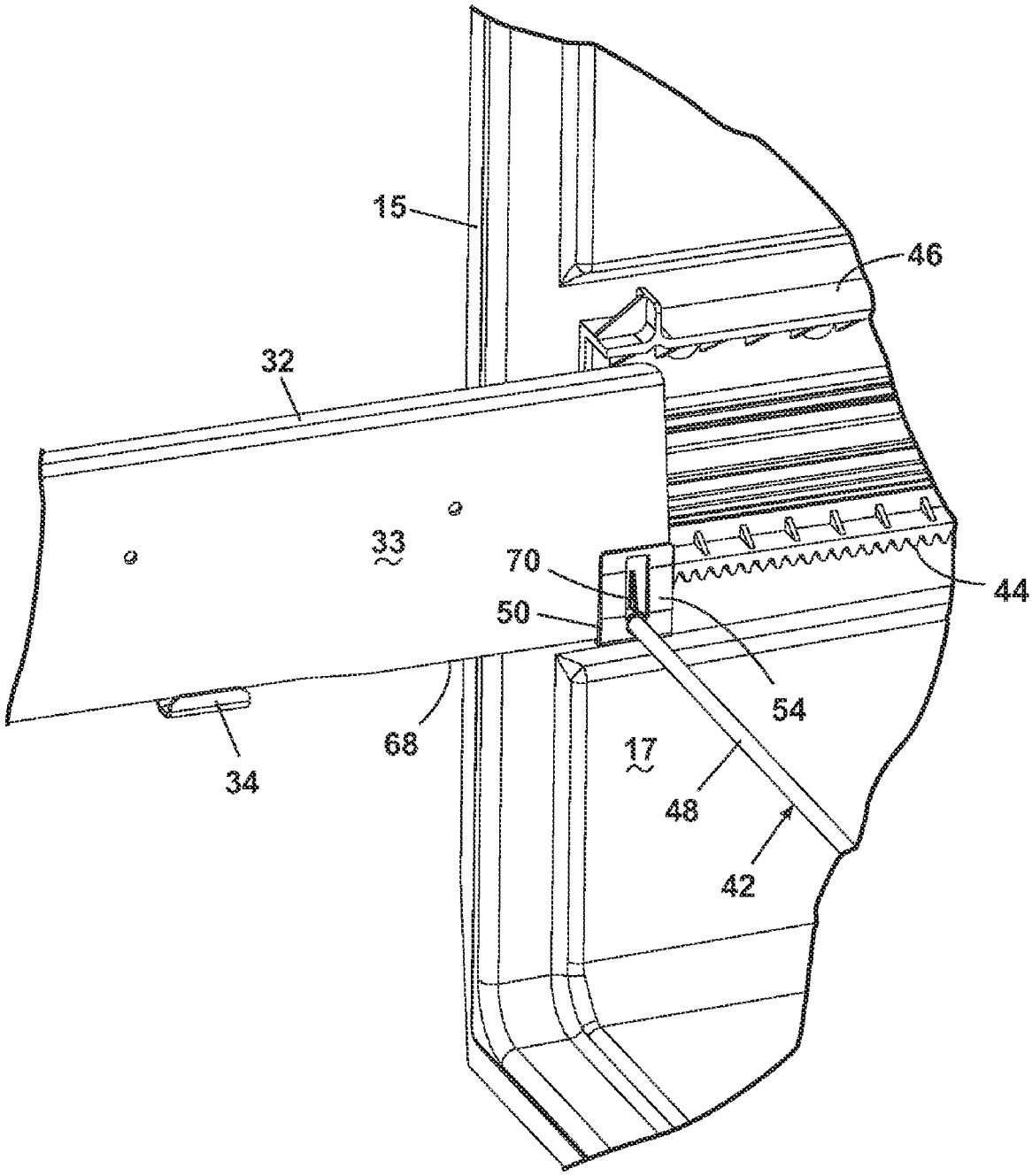
FIG. 8B is a partial perspective view of the drawer slide and bracket assembly installed in a freezer compartment with the snap-on pinion gear assembly attached to the drawer mounting brackets.
Figure 9:
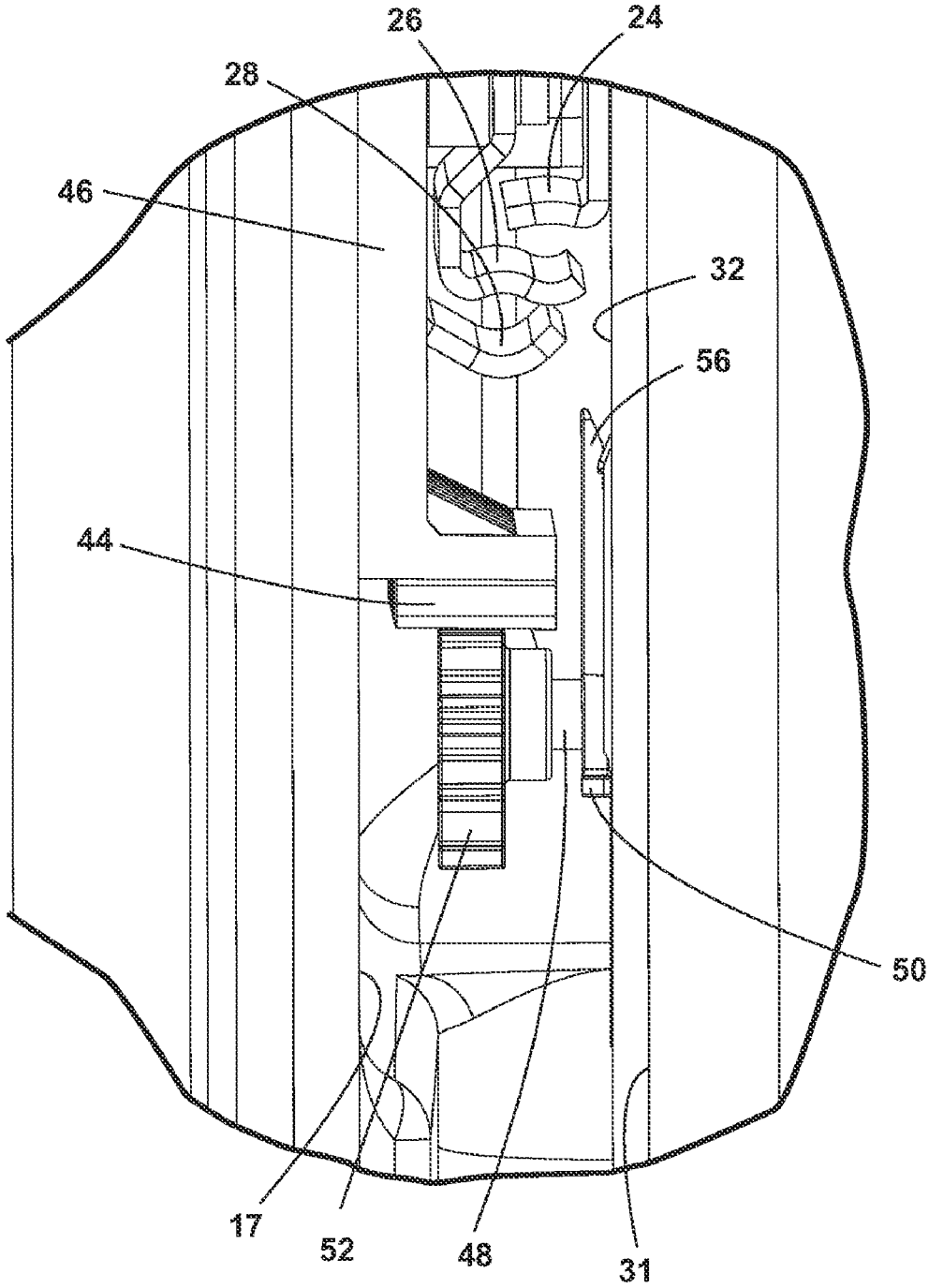
FIG. 9 is a partial elevation view of the drawer slide and bracket assembly installed in a freezer compartment with a pinion gear engaging a rack gear.

Referring again to FIG. 3 and FIGS. 7A and 8A, first member 54 and second member 56 can be axially spaced along journal 51 to engage opposite side surfaces 33 of mounting bracket 32. As a bearing bracket 50 is assembled to a mounting bracket 32 the ramp surface 60 can engage the bottom edge 68 of mounting bracket 32 bending first member 54 away from second member 56 to allow bearing bracket 50 to slide onto mounting bracket 50. Second member 56 can have a rib 70 extending generally perpendicular to journal 51 forming a ramp extending toward first member 54. Mounting bracket 32 can have a slot 72 extending generally perpendicular to recess 74 that can be formed in the bottom edge 68 of mounting bracket 32 that can be sized to receive rib 70. Recess 74 can be semi-circular to receive the upper surface 76 of journal 51 to locate pinion gear assembly along mounting bracket 32. As a bearing bracket 50 is slid into position on mounting bracket 32 rib 70 can engage slot 72 to guide bearing bracket onto mounting bracket 32 with upper surface 76 of journal 51 aligned in recess 74 and with latch surfaces 58 aligned with strikes 64. As noted above when ramp surfaces 60 engage bottom edge 68 first member 54 can deflect to allow ramp surfaces 60 to slide along slide wall 33 until the ramp surface drops into strike surface 64 opening 65. When bearing bracket 50 is fully slid on mounting bracket 32 ramp surface 60 can be received in strike surface 64 opening 65 with lock surface 62 engaging the edge 66 of the strike surface 64 locking bearing bracket 50 on mounting bracket 32. With two latch surfaces 58 engaging two strike surfaces, rib 70 engaging slot 72 and upper surface 76 of journal 51 engaging recess 74 bearing bracket is held securely in position on mounting bracket 32 and can thereby hold pinion gear 52 rotatably in position adjacent the bottom edge 68 of mounting bracket 32. FIGS. 7A and 8A illustrate pinion gear assembly 42 prior to assembly near mounting bracket 32 and FIGS. 7B and 8B illustrate pinion gear assembly 42 assembled to the mounting bracket 32 as described above. In the event it is desired to remove drawer 18 for cleaning or for service or for any reason, pinion gear assembly 42 can be detached from mounting brackets 32, without removing the freezer drawer 18, by flexing the first members 54 away from the side wall 33 of mounting bracket 32 sufficiently to withdraw latch surfaces 58 from strike openings 64 and sliding bearing bracket 50 downward off mounting brackets 32. For example, a screwdriver blade or similar instrument can be inserted between first member 54 and mounting bracket 32 to flex first member 54 sufficiently to allow latch 58 to slide out of strike 64 and down the surface 33 or mounting bracket 32. An advantage of the rack and pinion stabilizing system according to the invention is that the pinion gear assembly 42 can be removed and replaced without removing the drawer/door. In competitive designs the drawer must be removed in order to replace the pinion gear assembly, or even to "reset" the rack and pinion stabilizing system in the case that teeth become misaligned side to side.

Referring now to FIGS. 2, 6, 7B and 9 when pinion gear assembly 42 is snapped into position on mounting brackets 32, pinion gears 52 engage downward facing rack gears 44 on each side of drawer 18. When pinion gears 52 are engaged with rack gears 44 as drawer 18 is moved in or out, pinion gears 52 rotate along rack gears 44. As described above, pinion gears 52 are connected by shaft 48, and since the shaft 48 has flattened portions 49 and pinion gears 52 have mating surfaces 53 that engage flattened portions 49, each pinion gear 52 must rotate at the same speed providing equal linear motion along the respective rack gears 44. Thus, slide assemblies 22 can only move linearly with each side of drawer 18 moving the same amount as pinion gears 52 rotate and move along rack gears 44. Accordingly, drawer motion is stabilized against rack and wobble as the drawer is extended from and inserted into the freezer compartment 16 of the refrigerator 10. As noted above, use of a rack and pinion stabilizer for a drawer or other pull-out apparatus can assure that the drawer or pull-out apparatus moves uniformly as it is pulled out or pushed in, even if the force is not applied evenly to the drawer or apparatus thus assuring the drawer or apparatus remains in alignment.

Referring to FIG. 2, a drawer slide and bracket assembly 38 according to the invention can be assembled as follows. A C-shaped channel 46 including rack gear 44 can be attached to a slide assembly 22 by, for example, riveting a C-shaped channel 46 to outer section 28 of slide assembly 22 to hold C-shaped channel 46 in position on slide assembly 22. A mounting bracket 32 can be attached to slide assembly 22 by, for example, riveting a mounting bracket 32 to inner section 24 thus forming a drawer slide and bracket assembly 38. In FIG. 2 a pair of drawer slide and bracket assemblies are illustrated with a pinion gear assembly 42 attached. Those skilled in the art will understand that suitable fixtures can be used when a C-shaped channel 46 is attached to outer section 28 and when a mounting bracket 32 is attached to inner section 24 to assure that the elements of drawer slide and bracket assembly 38, slide assembly 22, C-shaped channel 46 and mounting bracket 32, will be correctly positioned relative to one another. To assure that the drawer slide and bracket assemblies 38 are correctly positioned in freezer compartment 16 a fixture, not shown, can be positioned in freezer compartment 16 that can be used to locate and pre-drill holes, not shown, in the side walls 17 of freezer compartment for mounting drawer slide and bracket assemblies 38 on the side walls 17 of the freezer compartment 16. If desired, side walls 17 can be reinforced where fasteners will attach the drawer slide and bracket assembly 38 to the side walls 17. For example, a metal plate, not shown, can be positioned in the insulation space adjacent side walls 17 to reinforce the portion of side walls 17 to which the drawer slide and bracket assembly will be attached. A metal plate can not only provide a secure mounting for the fasteners used to attach the drawer slide and mounting bracket 38, but can also function to spread the load of a filled freezer drawer 18 over a larger area of the side wall 17 of freezer compartment 16 than only where fasteners (not shown) attach the drawer slide and bracket assembly 38 to a side wall 17. Those skilled in the art will understand that suitable fasteners such as threaded fasteners or other well known suitable fasteners can be used to attach a drawer slide and bracket assemblies 38 to the side walls 17 of the freezer compartment 16.

Following attachment of drawer slide and bracket assemblies 38 in a freezer compartment, freezer drawer 18 can be assembled by attaching a drawer front 30 to mounting brackets 32. Mounting brackets 32 can include mounting flanges 31 that can have two or more holes 35 (see FIG. 2) to receive fasteners to secure at least one drawer element, drawer front 30, to mounting brackets 32. Drawer front 30 can have a surface, not shown, to engage mounting flanges 31 to properly position drawer front on mounting flanges 31 while fasteners (not shown) are driven into the inner surface (not shown) of drawer front 30 to attach each mounting flange 31 to drawer front 30 as is well known to those skilled in the art. If desired, drawer front 30 can have reinforced sections where mounting flanges 31 are attached to the drawer front by suitable fasteners. Drawer front 30 can have handle 20 attached to drawer front 30 prior to drawer front 30 being attached to mounting flanges 31, although, if desired drawer handle 20 can be assembled after assembly of the freezer drawer 18 is complete.

After freezer drawer front 30 is attached to mounting brackets 32 forming freezer drawer 18, freezer drawer 18 can be fully withdrawn so that the drawer slide and bracket assembly 38 is fully extended as illustrated in FIG. 2. With freezer drawer 18 fully extended and properly aligned for movement parallel to slides 22, pinion gear assembly 42 can be attached to mounting brackets 32 as described above by positioning pinion gear assembly 42 in the position shown in FIGS. 7A and 8A, and then sliding the bearing brackets 50 upward into engagement with mounting brackets 32 until the bearing brackets 52 snap into the position illustrated in FIGS. 7B, 8B and 9 with pinion gears 52 engaging rack gears 44 and latch surfaces 58 engaging strikes 64. Assembling pinion gear assembly 42 to freezer drawer 18 in the fully extended position assures that the rack and pinion stabilizing system is properly aligned and that the freezer drawer 18 will close and seal properly to cabinet 12. As is well known in the art freezer drawer 18 can have suitable seals (not shown) on the surface of freezer drawer 18 that contact cabinet 12 at drawer opening 15 to help assure sealing of the freezer compartment when the freezer drawer 18 is closed. With the pinion gear assembly 42 attached, basket 36 can be assembled to freezer drawer 18 by inserting basket 36 between mounting brackets 32 until basket 36 engages mounting hooks 34 to support the basket in drawer 18. Thus, the rack and pinion stabilizer according to the invention can be easily assembled to a drawer or other pull-out apparatus with the drawer or pull-out apparatus properly aligned. As freezer drawer 18 is opened and closed pinion gears 52 connected by shaft 48 have equal rotational and linear motion along the respective rack gears 44. Accordingly, drawer motion is stabilized against rack and wobble as it is extended from and inserted into the freezer compartment 16 of the refrigerator cabinet 12. This system allows the drawer to be extended and inserted with a consistent and correct orientation to assure an effective seal to prevent air from permeating into or out of freezer drawer making it difficult to regulate temperatures, humidity and other factors within the drawer.

While the invention has been specifically described in connection with certain specific embodiments thereof, it is to be understood that this is by way of illustration and not of limitation, and the scope of the appended claims should be construed as broadly as the prior art will permit.

We claim:

1. A pull-out apparatus having a rack and pinion stabilizing system comprising:

first and second slide assemblies positioned to movably support the pull-out apparatus;

a rack gear associated with each of the first and second slide assemblies;

a snap-on pinion gear assembly comprising:

a shaft;

first and second pinion gears on opposite ends of the shaft; and first and second bearing brackets rotatably supporting the shaft;

first and second mounting brackets connected to the pull-out apparatus and attached to respective first and second slide assemblies, the first and second mounting brackets each including a bottom edge having a recess to receive the shaft and at least one strike surface;

wherein each bearing bracket includes at least one latch surface arranged to engage said mounting bracket strike surface to attach the pinion gear assembly to the pull-out apparatus with each pinion gear engaging a respective rack gear; wherein the bearing brackets each include a journal to rotatably support the shaft, a first member extending generally perpendicular to the journal and a second member extending generally perpendicular to the journal and generally parallel to the first member, and further wherein the first member and the second member are arranged to receive the mounting bracket between said first and second members.

2. The pull-out apparatus according to claim 1, wherein the pull-out apparatus comprises a drawer slideably mounted in a cabinet and further wherein the first and second slide assemblies are mounted to the cabinet.

3. The pull-out apparatus according to claim 1, wherein each said rack gear is connected to each of the first and second slide assemblies.

4. The pull-out apparatus according to claim 3, wherein the rack gear is pan of a C-shaped channel connected to each of the first and second slide assemblies.

5. The pull-out apparatus according to claim 1, wherein the first member includes the at least one latch surface arranged to engage the at least one strike surface.

6. The pull-out apparatus according to claim 5, wherein the first members include two latch surfaces and the mounting brackets each include two strike surfaces.

7. The pull-out apparatus according to claim 6, wherein the second members include a rib extending generally perpendicular to the journal and toward the first member and the mounting bracket each include a slot extending generally perpendicularly from the recess to receive the rib to locate the bearing bracket with the latch surfaces aligned with the strike surfaces.

8. The pull-out apparatus according to claim 7, wherein the first member is flexible to allow the latch surfaces to slide on the mounting bracket side and engage the strike surfaces as bearing brackets are assembled to the mounting brackets.

9. The pull-out apparatus according to claim 6, wherein the latch surfaces comprise a ramp extending upwardly from the surface of the first members toward the second member and a lock surface extending generally perpendicular from the surface of the first member to the distal end of the ramp.

10. The pull-out apparatus according to claim 9, wherein the strike surfaces comprise an opening in the mounting brackets arranged to receive the latch surface with the lock surface engaging the edge of the opening.

11. A cabinet including a drawer having a rack and pinion stabilizing system comprising:

first and second slide assemblies mounted in the cabinet;

a rack gear connected to each of the first and second slide assemblies;

spaced mounting brackets connected to the first and second slide assemblies and connected to the drawer and having opposite sides and a bottom edge, each mounting bracket comprising:

a recess in the bottom edge;

a slot extending from the recess generally perpendicular to the bottom edge; and two strike surface openings in the mounting brackets adjacent the slot;

a snap-on pinion gear assembly comprising:

a shaft;

first and second pinion gears mounted on opposite ends of the shaft; and first and second bearing brackets comprising:

a journal arranged to rotatably support the shaft;

a first member extending generally perpendicular to the journal;

a second member extending generally perpendicular to the journal and generally parallel to the first member, with the first and second members being arranged to engage the opposite sides of the mounting bracket;

the first members having two latch surfaces each comprising a ramp extending upwardly from the surface of the first member toward the second member and a lock surface arranged to engage the two strike surface openings in the mounting bracket; and the second members having a rib extending generally perpendicular to the journal and arranged to engage the slot to locate the bearing bracket with the latch surfaces aligned with the strike surface openings.

12. The cabinet according to claim 11, wherein the cabinet comprises a refrigerator freezer having a freezer compartment comprising a drawer opening in the bottom portion of the cabinet and the drawer comprises a freezer compartment drawer.

13. The a cabinet according to claim 12, wherein the drawer includes an insulated drawer front for closing the drawer opening in the cabinet and wherein the insulated drawer front is attached to the spaced mounting brackets.

14. The cabinet according to claim 13, wherein the spaced mounting brackets support a container for holding items in the freezer compartment.

15. A method for assembling a drawer and a rack and pinion stabilizing system in a cabinet comprising:

providing a cabinet having first and second slide assemblies including first and second rack gears and first and second spaced drawer mounting brackets each including at least one strike surface;

attaching at least a drawer element to the first and second drawer mounting brackets;

providing a snap-on pinion gear assembly comprising: a shaft; first and second bearing brackets rotatably supporting the shaft including at least one latch surface and a journal to rotatably support the shaft, a first member extending generally perpendicular to the journal and a second member extending generally perpendicular to the journal and generally parallel to the first member, and further wherein the first member and the second member are arranged to receive the mounting bracket between said first and second members; and first and second pinion gears at the opposite ends of the shaft; and assembling the pinion gear assembly to the slide assembly by connecting the first and second bearing brackets to the first and second mounting brackets with the first and second members receiving a respective drawer mounting bracket with the at least one latch surface engaging the at least one strike surface, and the first and second pinion gears engaging the first and second rack gears.

16. A method of assembling a freezer drawer having a rack and pinion stabilizing system in a refrigerator freezer cabinet drawer cavity comprising:

mounting rack gears to first and second slide assemblies;

attaching mounting brackets each including at least one strike surface to the first and second slide assemblies;

mounting the first and second slide assemblies including the rack gears and mounting brackets to opposite side walls of the drawer cavity;

attaching an insulated drawer front to the mounting brackets;

providing a snap-on pinion gear assembly comprising: a shaft; first and second bearing brackets rotatably supporting the shaft including at least one latch surface and a journal to rotatably support the shaft, a first member extending generally perpendicular to the journal and a second member extending generally perpendicular to the journal and generally parallel to the first member, and further wherein the first member and the second member are arranged to receive the mounting bracket between said first and second members; and first and second pinion gears at the opposite ends of the shaft;

extending the insulated drawer front to a fully extended position; and assembling the pinion gear assembly to the mounting brackets by connecting the first and second bearing brackets to respective mounting brackets with the first and second members receiving a respective drawer mounting bracket with the at least one latch surface engaging the at least one strike surface, and the first and second pinion gears engaging the rack gears.

17. The method of assembling a freezer drawer according to claim 16, wherein the method further comprises the step of assembling a container to the mounting brackets after the step of assembling the pinion gear assembly to the mounting brackets.

* * * * *